United States Patent [19]

Gordon

[11] Patent Number: 4,998,361

[45] Date of Patent: Mar. 12, 1991

[54] COMBINATION PICTURE FRAME AND ALBUM

[75] Inventor: Melvin L. Gordon, West Palm Beach, Fla.

[73] Assignee: Melannco International Ltd., Chelsea, Mass.

[21] Appl. No.: 299,089

[22] Filed: Jan. 23, 1989

[51] Int. Cl.[5] ..... G09F 1/12

[52] U.S. Cl. ..... 40/152; 40/156; 206/45.31; 206/451

[58] Field of Search ..... 40/152, 152.1, 155, 40/156; 206/45.31, 451

[56] References Cited

U.S. PATENT DOCUMENTS

| | | | |
|---|---|---|---|
| 1,940,328 | 12/1933 | Schrotenboer | 40/152 |
| 2,617,217 | 11/1952 | Behr | 40/152.1 |
| 2,649,799 | 8/1953 | Spertus | 40/152 |
| 2,839,857 | 6/1958 | Teller | 40/152 |
| 2,889,036 | 6/1959 | Davies | 40/152 |
| 3,084,473 | 4/1963 | Castro | 40/336 |
| 3,108,684 | 10/1963 | Apicella | 206/45.31 |
| 3,557,480 | 1/1971 | Ebner | 40/152.1 |
| 3,589,049 | 6/1971 | Cornelius | 40/152 |
| 3,664,048 | 5/1972 | Karlson | 40/336 |
| 3,665,627 | 5/1972 | MacCluney | 40/152 |
| 3,787,992 | 1/1974 | Leonhardt | 40/152 |
| 4,320,591 | 3/1982 | Dorman | 40/124 |
| 4,691,456 | 9/1987 | Ackevet | 40/152.1 |
| 4,856,213 | 8/1989 | Hord | 40/152.1 |

FOREIGN PATENT DOCUMENTS

| | | | |
|---|---|---|---|
| 568168 | 3/1945 | United Kingdom | 40/152 |

*Primary Examiner*—Kenneth J. Dorner
*Assistant Examiner*—Brian K. Green
*Attorney, Agent, or Firm*—Wolf, Greenfield & Sacks

[57] ABSTRACT

A combination picture frame and album wherein the picture frame has a removable front panel which enables the picture to be displayed to be mounted in the frame and thereafter retained in position when the panel is replaced. The album of the combination is stored beneath the frame and is inserted through an opening provided in the side wall. The album normally stored in the frame is removed to view the pictures mounted in it.

5 Claims, 4 Drawing Sheets

COMBINATION PICTURE FRAME AND ALBUM

This invention relates to the display of photographs and more particularly comprises a new and improved combination picture frame and album.

The prior art contains a variety of picture frames and separate photograph albums which are conventionally placed separately on tables, bookcases or the like. The present invention combines a photograph album with a picture frame as a unitary structure. Other prior art picture frames have include storage boxes in which photographs or other items may be stored. However, none has included an album which will hold photographs in an orderly and organized fashion. The present invention in separate embodiments utilizes a tray-like album containing overlapping clear plastic pockets and a book-like album with front and back covers connected by a spine and containing pages on which photographs or other pictures may be mounted or inserted.

In each of the embodiments of the present invention, one wall of the album lies in the side wall of the frame when the album is in the stored position so that the picture frame has continuous side walls that essentially disguise the dual character of the frame and album. A most attractive and neat assembly results that is suitable for display on a table, bookcase, or other furniture.

This invention will be better understood and appreciated from the following detailed description of two embodiments thereof, selected for purposes of illustration and shown in the accompanying drawings.

BRIEF FIGURE DESCRIPTION

DETAILED DESCRIPTION

Figure 1:
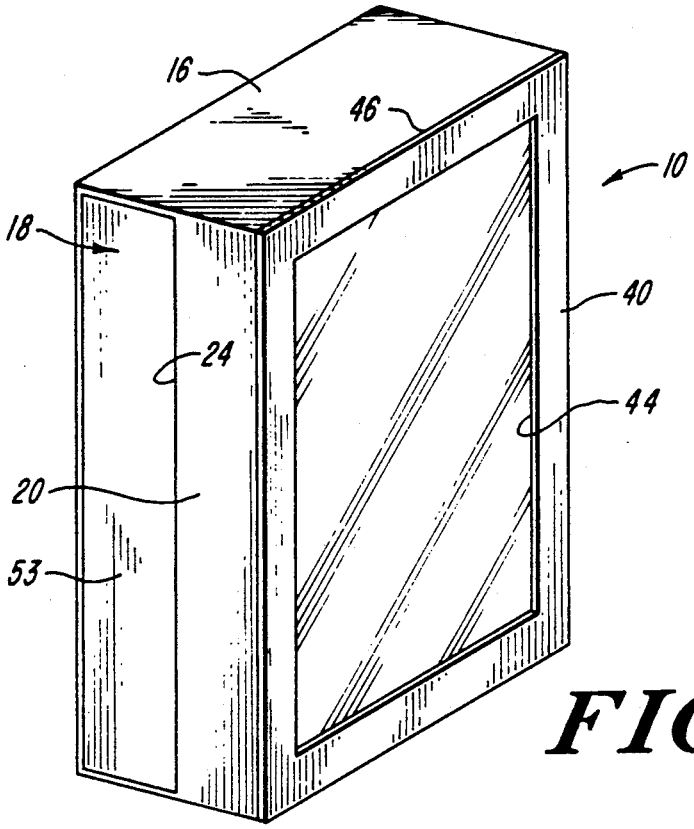
FIG. 1 is a perspective view of a combination picture frame and album constructed in accordance with this invention.
Figure 2:
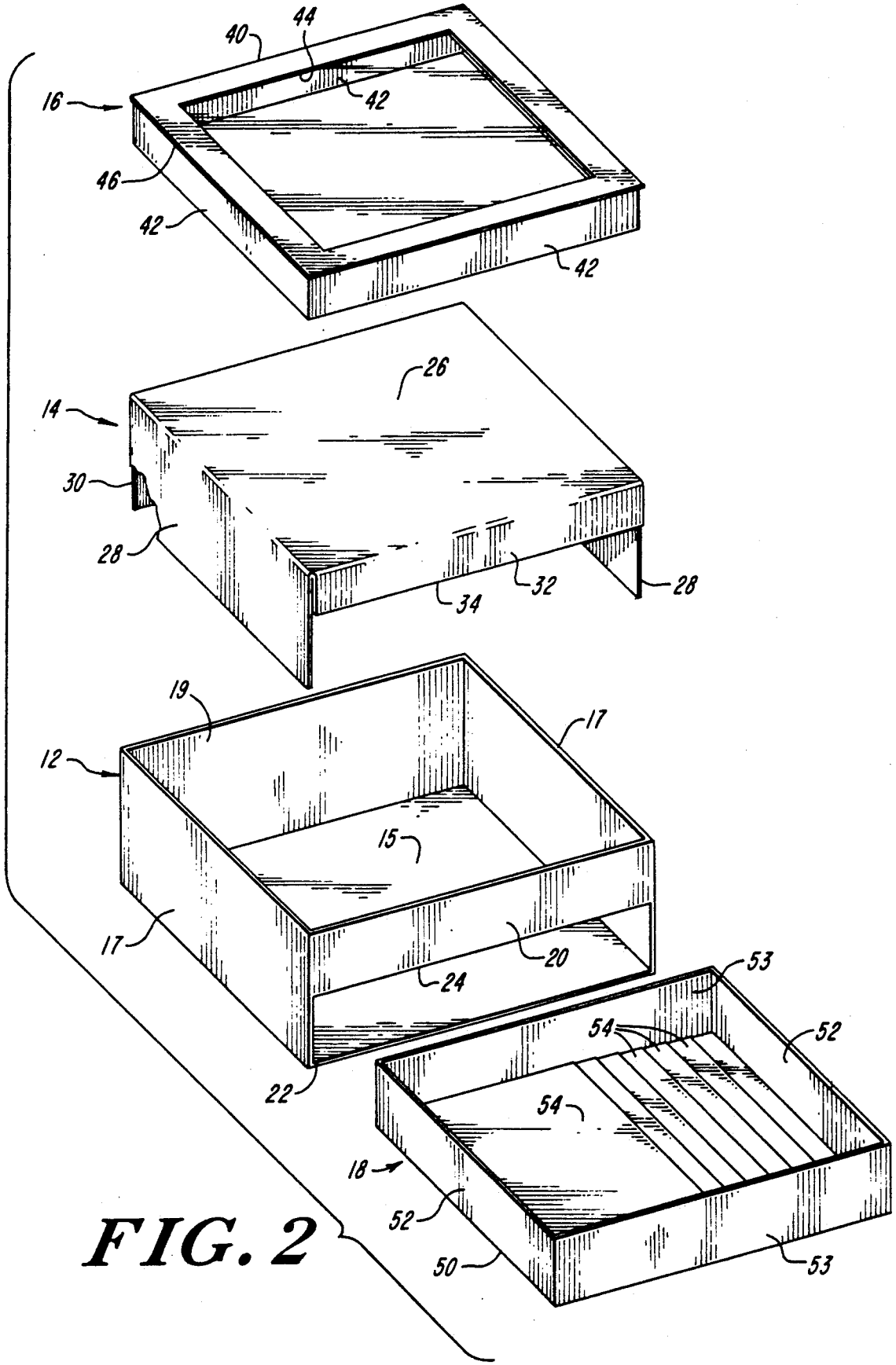
FIG. 2 is an exploded perspective view showing the various parts of the combination frame and album of FIG. 1.
Figure 3:
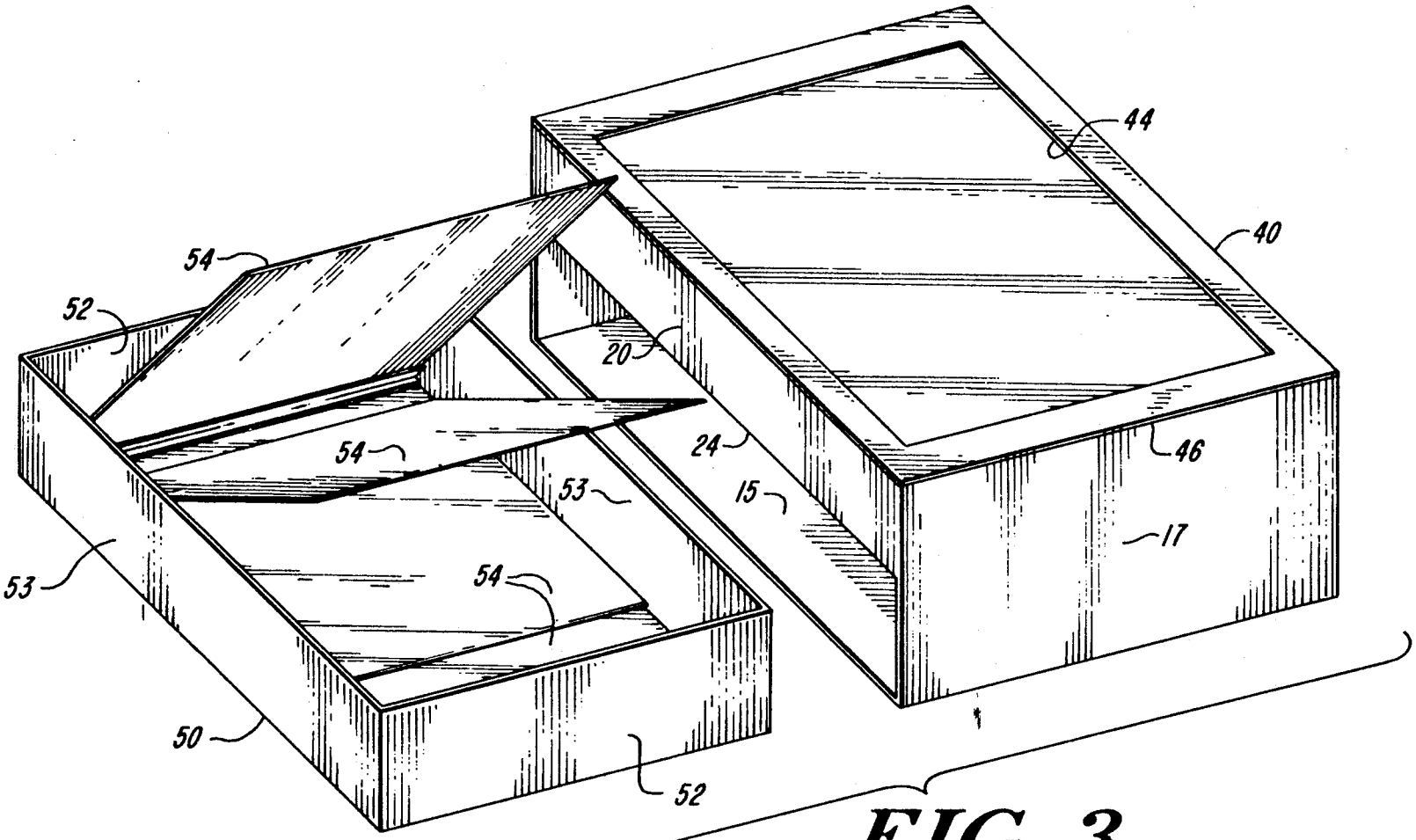
FIG. 3 is a perspective view of the combination picture frame and album of FIG. 1 with the frame and with the album removed.

In the embodiment of FIGS. 1–3 combination picture frame and album 10 is shown. In FIG. 1, the album of the combination is stored within the frame while in FIG. 3 the album is withdrawn from it so that the pictures in the album may be viewed. The combination picture frame and album of this embodiment as shown in FIG. 2 is composed essentially of four major parts, namely, a tray 12, support 14, frame member 16, and album 18.

The tray 12 may be made of wood, metal, paperboard or any suitable material having sufficient stiffness to perform its functions as hereinafter described. The tray 12 has a bottom wall 15, a first pair of side walls 17 and a second pair of opposite side walls 19 and 20. The outer surfaces of walls 15, 17, 19 and 20 should be suitably decorated so that the combination picture frame and album may be displayed either standing erect as in FIG. 1 or lying on the bottom wall 15 as in FIG. 3. Hereinafter when the words "bottom", "top" and "sides" are used in identifying various parts of the assembly, they are not to be deemed to limit the use of the combination frame and album to a particular position, but rather those terms merely identify the relative positions of the parts when the combination frame and album is disposed with its bottom wall 15 as in FIGS. 2 and 3. It will be appreciated that the album may be displayed resting upon any of the side walls so that the picture displayed in the frame is positioned in a vertical plane as in FIG. 1.

As noted in FIG. 2, the side walls 17, 19 and 20 are all of the same height, that is, their top edges are coplanar with one another and are parallel to the bottom wall 15. The side wall 20 is provided with an opening 22 that extends the full width of the wall 20 and upwardly from the bottom wall 15 to the top edge 24 of which is approximately midway between the bottom wall 15 and the top edge of wall 20. The opening 22 provides access to the tray through the side wall so that the album may be stored in it.

The support 14 provides a platform against which the picture to be displayed in the frame rests. The support includes a platform or supporting surface 26, a pair of legs 28 on opposite sides of the platform, a third leg 30, and a downwardly extending skirt 32. When the support 14 is placed in the open top of tray 12, the legs 28 and 30 lie against the inner surfaces of the side walls 17 and 19, and the skirt 32 bears against the inner surface of the tray wall 20. The lower edge 34 of the skirt is disposed immediately adjacent to or above the top edge 24 of the opening 22 in the tray so as not to interfere with access to the tray through the opening. The supporting surface 26 of the support 14 lies essentially in the plane of or slightly below the top edges of the walls 17, 19 and 20 of the tray. Substantial latitude, however, is given to the position of the surface. If a shadow box effect is desired for the frame, the supporting surface 26 may lie below the top edges of the walls 17, 19 and 20.

The frame member 16 includes a top wall 40 and four downwardly extending side walls 42. The top wall 40 has a large rectangular window 44 through which pictures placed on the platform 26 may be viewed. In the embodiment shown, the top wall 40 extends slightly beyond the outer surfaces of the side walls 42 to form a lip 46 that may engage the upper edges of the side walls 17, 19 and 20 of the tray 12 when the combination frame and album is assembled. If the frame is to be a shadow box, the lip 46 may be omitted so as to enable the top wall 46 to sit below the top edges of the side walls of the tray.

The album 18 in the embodiment of FIGS. 1–3 is in the form of a drawer having bottom wall 50, two opposite pairs of side walls 52 and 53, and a plurality of clear plastic pockets 54 secured to the bottom wall 50 of the album. The width and height of the side walls 53 of the album are essentially the same as the width and height of the opening 22 in the side wall 20 of the tray so that the album may be slipped into the tray 12 through the opening 22 and assume the position shown in FIG. 1. The bottom wall 50 of the album 18 is essentially the same size and shape as the bottom wall 15 of the tray so that when the album is inserted fully through the opening 22, one of its side walls 53 lies against the inside of tray wall 19 and the other is coplanar with the side tray wall 20.

The combination album and picture frame composed of the parts shown in FIG. 2 is assembled in the following manner. The support 14 is placed inside the tray 12 with its legs 28 and 30 lying against the inner surfaces of the side walls 17 and 19 of the tray and the skirt 32 lying against the inner surface of the side wall 20. When so assembled, the supporting surface 26 of the support lies just beneath the plane of the top edges of the side walls 17, 19 and 20 of the tray. The support 14 may be cemented or otherwise permanently fixed to the tray along the bottoms of the legs 28 and 30. The top portions of the side walls 28 and 30 as well as skirt 32 should not be attached to the insides of the walls 17, 19 and 20 for reasons which will become apparent presently.

With the support 14 positioned in the tray 12 as described, the picture to be displayed in the frame is centered on the platform 26 and preferably secured so that it will not shift with respect to it. If the picture is the same size as the platform 26 and the platform lies slightly beneath the top edges of the side walls 17, 19 and 20 of the tray 12, the tray side walls will, of course, prevent the picture from shifting.

Figure 6:
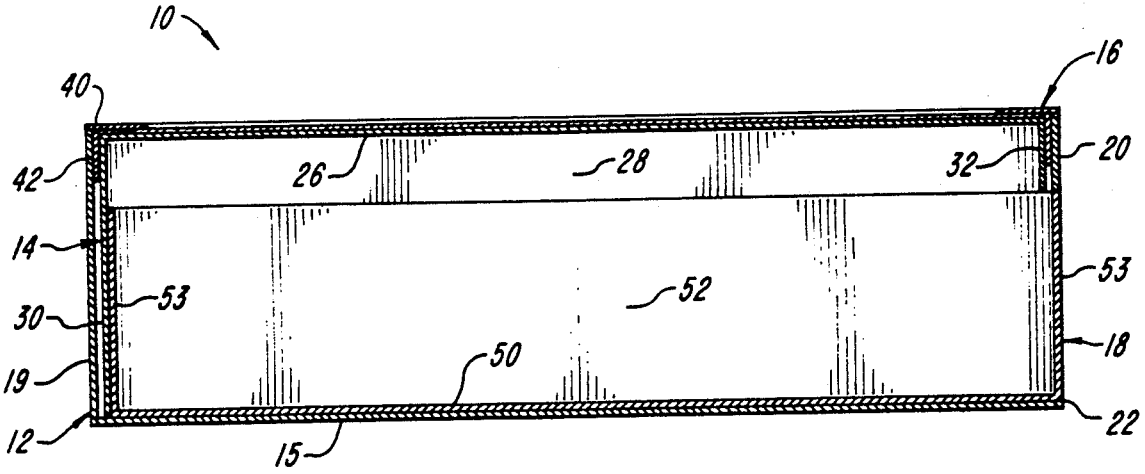
FIG. 6 is a cross-sectional view of the assembled combination frame and album of FIGS. 1–3.

After the picture is placed on the platform, the frame member 16 is mounted on the tray by inserting the side walls 42 of the frame member between the side walls 17, 19 and 20 of the tray and the legs 28 and 30, and the skirt 32 of the support 14. This arrangement is shown in FIG. 6. The side wall 42 of the frame member 16 between the side wall 20 of the tray and the skirt 32 of the support does not extend so far down as to obstruct the opening 22. Therefore, neither the support 14 nor frame 16 interfere with the insertion and removal of the album 18 into the tray through the opening 22. If the frame member 16 is provided with the shoulder 46, the shoulder will sit on the upper edges of the side walls of the tray. When the frame member 16 is assembled in that fashion, the picture placed on the platform 26 may be viewed through the window 44. It should be appreciated that the window may merely be an opening in the top wall 40, or alternatively, it may be a transparent panel made of glass, transparent plastic or the like.

The pockets 54 of album 18 may be filled with photographs in the conventional manner through openings (not shown) provided in the sides of the pockets. The drawer which comprises the album 18 is sufficiently deep so that it can contain beneath the top edges of its side walls 52 and 53 all of the photographs which are stored in the pockets. The album 18 is normally stored in the tray in the manner shown in FIG. 1, and the combination frame and album may be placed on a table, bookcase, hung on a wall, etc. for display of the picture contained in the frame. At any time, the album 18 may be removed from the tray through opening 22, and the pictures in the pockets 54 may be viewed merely by flipping the pockets over as suggested in FIG. 3.

Figure 4:
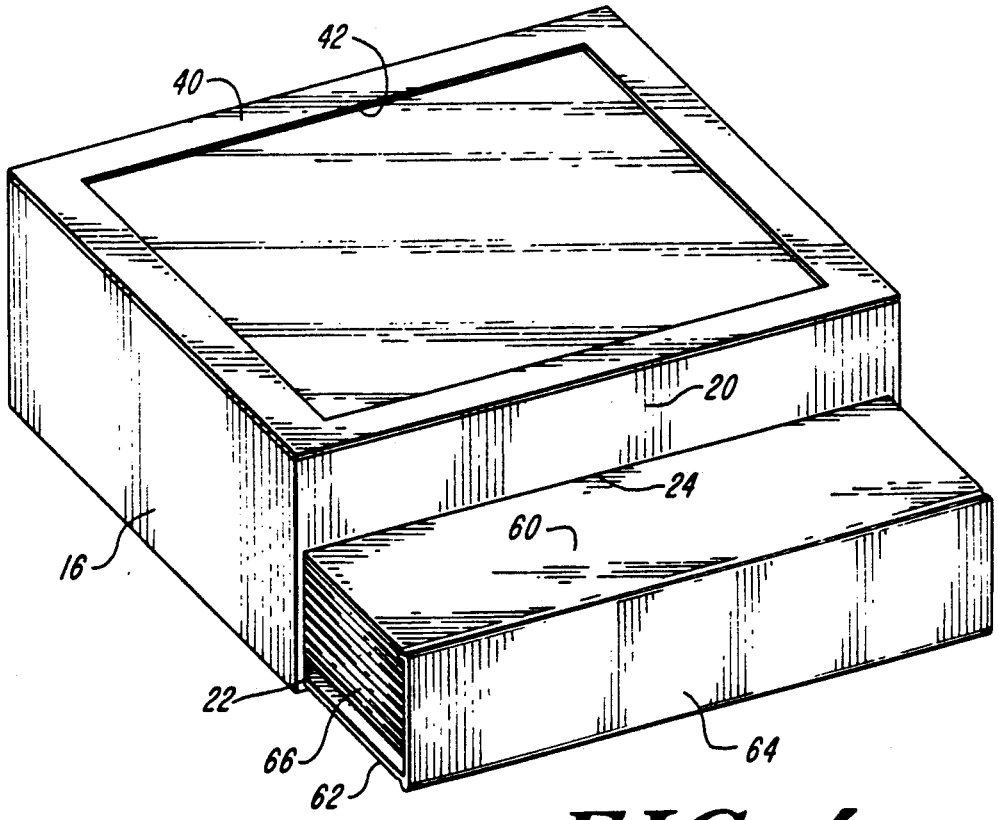
FIG. 4 is a perspective view of a second embodiment of combination picture frame and album showing the album partially withdrawn from the frame.
Figure 5:
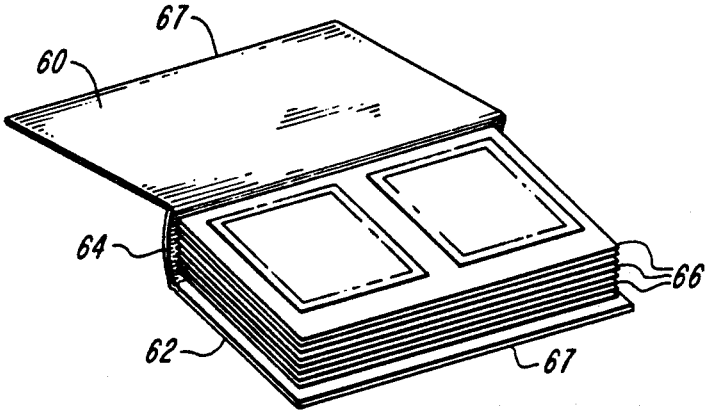
FIG. 5 is a perspective view of the album used in the embodiment of FIG. 4.

The embodiment of FIGS. 4 and 5 differs from the embodiment of FIGS. 1–3 only in the type of album that is used in the combination. While in the embodiments of FIGS. 1–3 the album is in the form of a drawer having transparent pockets mounted in overlap relationship on the album bottom wall 50, in the embodiment of FIGS. 4 and 5 the album is of conventional design having front and back covers 60 and 62, spine 64, and a number of pages 66 on which pictures may be mounted or inserted. The spine 64 comprises a side wall of the album when the album is closed. When the album is inserted into the opening 22 in side wall 20 of the tray, the spine 64 essentially fills the opening and lies coplanar with the side wall 20 just as shown in FIG. 1 as the edges 67 of the covers engage the inner surfaces of the tray side wall 19.

Having described this invention in detail, it will be appreciated that the combination frame and album of the present invention, if attractively finished makes a very appealing picture frame which may be displayed on a table, bookcase, or other furniture. The album stored in the frame may or may not contain pictures which are related to the principal picture displayed in the frame. The album whether in the form of the embodiment of FIGS. 1–3 or 4 and 5 may be removed from the tray of the frame whenever desired so that the pictures mounted in the album may be viewed.

Because numerous modifications may be made of this invention without departing from its spirit, it is not intended that the breadth of this invention be limited to the specific embodiments illustrated and described. Rather, it is intended that the scope of this invention be determined by the appended claims and their equivalents.

What is claimed is:

1. A combination picture frame and album comprising a tray open at a top and including a bottom wall and a plurality of side walls of equal height extending upwardly from the sides of the bottom wall and said side walls having tops, an opening in one of the side walls adjacent the bottom wall providing access to the interior of the tray through other than the open top, a support disposed in the tray having legs which rest on the bottom wall and a platform parallel to the bottom wall adjacent the tops of the and said platform having edges, said platform being suitable for supporting a picture to be displayed in the picture frame, a frame member having a panel with a window therein through which a picture on the platform may be viewed, said frame member having side walls which fit between the edges of the platform and the side walls of the tray for retaining the panel closely adjacent the platform, and an album for holding a plurality of pictures slidable in and out of the tray through the opening without disturbing the support and frame member.

2. The combination picture frame and picture album as defined in claim 1 wherein the legs are secured to the side walls of the tray.

3. The combination picture frame and picture album as defined in claim 1 wherein the album has a side wall which is coplanar with the tray side wall which contains the opening and which fills the opening when the album is in the tray.

4. The combination picture frame and album as defined in claim 3 wherein the side wall of the album is the spine thereof.

5. A combination picture frame and album as defined in claim 1 wherein said album is a drawer having bottom and side walls, one of said side walls of the album filling the opening when the drawer is in the tray, and clear plastic pockets secured to the bottom wall of the drawer for receiving photographs which may be viewed when the drawer is removed.

* * * * *